US006068006A

United States Patent [19]

Murphy

[11] Patent Number: 6,068,006

[45] **Date of Patent: *May 30, 2000**

[54] LUMINOUS UMBRELLA

[76] Inventor: Sean Murphy, 33 Wilkes Creek Dr., Port Moody, B.C. V3H 5A1, Canada

[ * ] Notice: This patent is subject to a terminal disclaimer.

[21] Appl. No.: 09/245,110

[22] Filed: Jan. 28, 1999

Related U.S. Application Data

[63] Continuation of application No. 09/079,959, May 15, 1998, Pat. No. 5,960,805, which is a continuation-in-part of application No. 08/852,685, May 7, 1997, abandoned.

[51] Int. Cl.[7] ..... A45B 3/00

[52] U.S. Cl. ..... 135/16; 135/910; 362/102

[58] Field of Search ..... 135/15.1, 16, 910; 362/102, 191, 234, 431

[56] References Cited

U.S. PATENT DOCUMENTS

| | | | |
|---|---|---|---|
| 1,166,272 | 12/1915 | Smithing . | |
| 2,087,537 | 7/1937 | Finkel . | |
| 3,275,815 | 9/1966 | Petroff et al. . | |
| 3,281,586 | 10/1966 | Gonzalez . | |
| 3,313,929 | 4/1967 | Schiavone . | |
| 3,870,062 | 3/1975 | Medlin . | |
| 3,873,821 | 3/1975 | Larson . | |
| 4,031,381 | 6/1977 | Carver . | |
| 4,271,604 | 6/1981 | Rowsey . | |
| 4,300,582 | 11/1981 | Desarno . | |
| 4,848,385 | 7/1989 | Pennella . | |
| 4,962,779 | 10/1990 | Meng . | |
| 5,023,757 | 6/1991 | Shirilla | 135/910 |
| 5,053,931 | 10/1991 | Rushing | 135/910 |
| 5,126,922 | 6/1992 | Andreasen | 135/910 |
| 5,219,402 | 6/1993 | Kondo | 135/910 |
| 5,463,536 | 10/1995 | Chou | 135/910 |
| 5,584,564 | 12/1996 | Phyle | 135/910 |

FOREIGN PATENT DOCUMENTS

| | | |
|---|---|---|
| 2101508 | 5/1995 | Canada . |
| 0 318 621 | 6/1989 | European Pat. Off. . |
| 36 03 397 | 5/1987 | Germany . |
| 296 18 520 U | 2/1997 | Germany . |
| 2 052 037 | 1/1981 | United Kingdom . |

*Primary Examiner*—Beth A. Aubrey
*Attorney, Agent, or Firm*—Robert H. Barrigar; Barrigar & Moss

[57] ABSTRACT

The luminous umbrella of the present invention uses a high proportion of the light generated by mounting the light bulb high on the shaft such that most of the light from the light bulb is projected at the highly reflective undersurface. The curvature of the undersurface focusses the light from the light bulb down to illuminate a space immediately around the user. This illuminated space widens towards the bottom, thereby providing the widest illumination at the ground where it is most needed. As a result of the light being efficiently focussed, the required luminosity of the light bulb is reduced, enabling the umbrella to be used using an incandescent light bulb and a few 1.5 volt batteries. Alternatively, if it is desired to provide increased illumination, the conventional incandescent bulb may be replaced with a halogen bulb. The batteries will still suffice to provide bright illumination by the halogen bulb. Preferably the bulb is retractable to within a protective bulb housing during non-use to mitigate the risk of breakage.

12 Claims, 4 Drawing Sheets

LUMINOUS UMBRELLA

RELATED APPLICATION

This application is a continuation of U.S. patent application Ser. No. 09/079,959, filed May 15, 1998, U.S. Pat. No. 5,960,805, the entire contents of which are incorporated by reference herein. Application Ser. No. 09/079,959 is a continuation-in-part application of U.S. patent application Ser. No. 08/852,685, filed May 7, 1997 now abandoned.

FIELD OF THE INVENTION

The invention relates generally to umbrellas and more particularly to an energy-efficient luminous umbrella.

BACKGROUND OF THE INVENTION

When it is raining, visibility is generally reduced, making it possible that people in the rain will fail to see obstructions such as puddles or curbs. This, in turn, increases the likelihood of accidental soakings, or falls and possible injury.

While prior luminous umbrellas have been devised, such luminous umbrellas are not suitable for providing illumination to a mobile user while it is raining. For example, U.S. Pat. No. 2,087,537 (Finkel) discloses a garden umbrella having a light source that projects light upwardly. Some of the light projected upwardly is reflected by a disc mounted above the light. The light source receives electricity from an outlet via an extension cord; the umbrella is intended to be stationary during use.

U.S. Pat. No. 3,275,815 (Petroff ) discloses an umbrella in which a light is mounted in the end of a handle. The handle light projects light in a generally upward direction, some of the light being directed to the undersurface of the umbrella canopy. The fabric of the umbrella canopy is reflective with respect to some light and transparent with respect to other light so that both top and bottom surfaces of the umbrella canopy are luminous. While some of the light from the handle light may provide useful illumination, most of the light is projected off into the distance where it is dissipated in the darkness and does not provide useful illumination in the vicinity of the user.

U.S. Pat. No. 3,313,929 (Schiavone) discloses a luminous umbrella having a tubular source of light contained within the uppermost part of the umbrella shaft, adjacent to the umbrella canopy. The tubular source of light projects light outwardly in both an upwards and downwards direction. Some of the light that is projected upwardly shines through the umbrella canopy, causing the fabric to take on a subdued glow. Optionally, the umbrella canopy may be made partially reflective by applying a reflective coating, such as a paint containing dispersed aluminum particles. The Schiavone umbrella is stationary, requiring electricity from an outlet to provide power for the light.

None of the foregoing umbrellas is suitable for providing illumination that enables mobile users to view their immediate surroundings while carrying the umbrella unfurled. In particular, the Finkel umbrella and Schiavone umbrella are intended to be stationary, and require an outlet to power their respective lights. While the Petroff umbrella is portable, it may not provide sufficient illumination to enable users to view their immediate surroundings, as most of the light is lost as it is projected off into the distance or shines through the umbrella canopy.

Thus, a luminous umbrella that is portable and provides sufficient illumination to enable users to view their immediate surroundings, is desirable.

SUMMARY OF THE INVENTION

An object of one aspect of the present invention is to provide a luminous umbrella that concentrates illumination from the light source in the vicinity of the user. In accordance with the foregoing aspect of the invention, there is provided a closable luminous umbrella for illuminating an illuminated space proximate to the luminous umbrella. The umbrella comprises a shaft, a collapsible canopy for sheltering the user, a handle mounted on the proximal end of the shaft, a light fixture, a power connection means and a light switch.

The collapsible canopy is mounted on a distal end of the shaft, and when opened has a highly reflective concave undersurface extending to an outer periphery to define a generally circular concavity underneath the collapsible canopy. The handle is mounted on the proximal end of the shaft. The light fixture replaceably receives and orients a light source such that when the light source is installed and operating and the umbrella is open, the light source faces the undersurface of the collapsible canopy, and is mounted on the shaft between the crest and the handle, so that most of the light from the light source is directed toward the ground when the open umbrella is in use in vertical orientation, either directly or by reflection from the undersurface of the collapsible canopy.

The power connection means is for connection to an integrable power source to integrally power the light source, thereby permitting the light source to operate during transportation. The light switch electrically connects and disconnects the light source and the integrable power source, thereby turning the light source on and off.

Preferably, light fixture comprises a bulb fixture for removably receiving a replaceable bulb, and a bulb housing mounted on the shaft within the concavity defined by the undersurface of the collapsible canopy when the umbrella is open. The bulb fixture is preferably mounted in the bulb housing such that the bulb fixture is retractable into the bulb housing in order to protect the bulb during non-use, and is extendable out of the bulb housing during use to enhance illumination.

BRIEF DESCRIPTION OF THE DRAWINGS

A detailed description of the preferred embodiments is provided herein below with reference to FIG. 1 that, in a sectional schematic view, illustrates a luminous umbrella constructed in accordance with an embodiment of the present invention.

DETAILED DESCRIPTION OF THE PREFERRED EMBODIMENTS OF THE INVENTION

Figure 1:
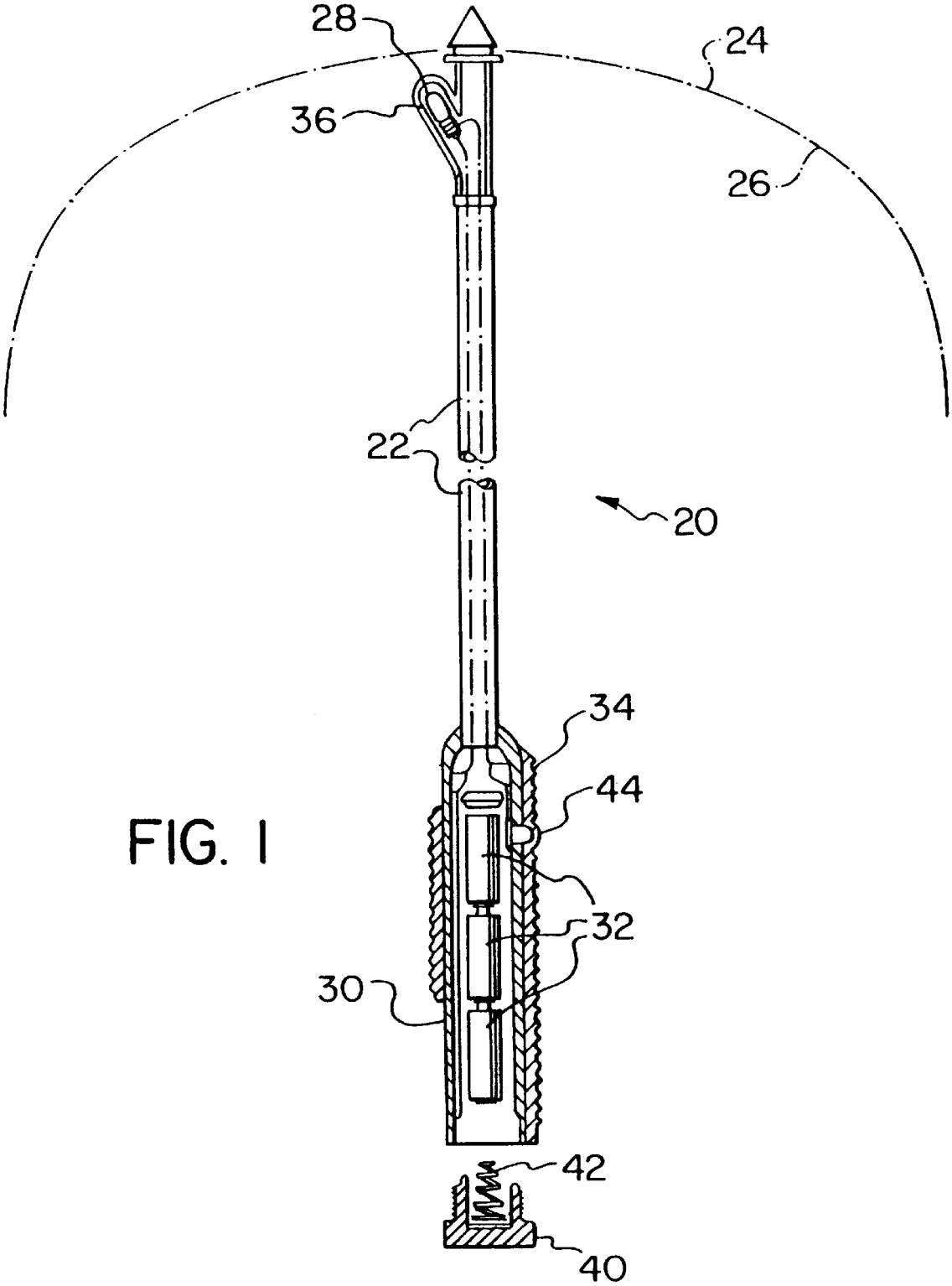

Referring to FIG. 1, there is illustrated in a sectional view, a luminous umbrella 20 in accordance with a preferred embodiment of the invention. The luminous umbrella 20 includes a shaft 22 and a collapsible canopy 24. The collapsible canopy 24 is mounted at the distal end of the shaft 22. When open, the collapsible canopy 24 extends radially outwardly and also downwardly (as viewed in FIG. 1, which illustrates the normal open position of the umbrella 20) from the crest 23 to define a concavity underneath the collapsible canopy. The canopy 24 has a generally circular symmetry about the shaft 22, but the usual strengthening ribs normally found in association with umbrella canopies may be provided also as required.

The collapsible canopy 24 has a highly reflective undersurface 26. In the embodiment shown, the collapsible canopy 24 is deeply curved in that when the umbrella 20 is open (open), the outermost part of the collapsible canopy 24 extends downwardly at a constant radial distance from the shaft 22, or even slightly inwardly towards the shaft 22, such that most of the light shone on any part of the reflective undersurface 26 is focussed to concentrate the illumination underneath the canopy 24.

A light bulb 28 is mounted on the shaft 22 between the handle 30 and the crest 23 of the collapsible canopy 24, and faces the undersurface 26 such that much of the light from the light bulb 28 is projected at the undersurface 26. In the embodiment of FIG. 1, the light bulb 28 is within the concavity defined by the undersurface 26; therefore, apart from a minor amount of light striking the shaft 22, which can also be reflective in the vicinity of the light source 28 (see discussion below), the remaining light that is not projected onto the undersurface 26 is projected underneath the collapsible canopy 24. The bulb is positioned so that the majority of the light emitting portion of the bulb protrudes from the shaft surface, thereby minimizing the amount of light that is blocked by the shaft.

Preferably, the shaft 22 is reflective proximate to the bulb 28 to reflect light that is projected at the shaft 22. The light bulb 28 is shielded from water by a bulb case 36. The reflective undersurface 26 is preferably a silver or white colour and has an extremely high luminous reflectance such that most of the light from the light bulb 28 is reflected by the undersurface 26. The shaft 22, at least in the vicinity of the light source 28, may also be of reflective silver or white colour. Due to the shape and orientation of the undersurface 26, resulting from the deep curvature of the canopy 24, the light that is reflected by the undersurface 26 of the collapsible canopy 24 is focused primarily underneath the collapsible canopy 24 such that relatively little light is projected radially far beyond the collapsible canopy 24. Of course, the focussing of the light provided by the undersurface 26 is diminished as the distance from the undersurface 26 increases, so that light that is projected radially beyond the collapsible canopy 24 is typically concentrated on the ground, thereby illuminating the ground around the user of the umbrella to enable the user to notice puddles or other obstacles.

The undersurface 26 can be made reflective by applying a reflective coating to a substantially opaque collapsible canopy 24. Preferably, however, the undersurface 26 is made reflective by attaching a film or sheet of highly reflective material to the underside of the collapsible canopy 24. The outer layer of the collapsible canopy 24 preferably comprises a substantially opaque and waterproof fabric.

In the embodiment shown in FIG. 1, the shaft 22 has a handle 30 at its proximal end. The handle 30 includes an end cap 40 that is removable to permit batteries 32 to be inserted into a housing 46 within the handle 30. The batteries 32 are connected to the light bulb 28 via conductors 38. When a push-button 44 is pressed, the circuit between the batteries 32 and light bulb 28 is opened or closed thereby turning the light on and off. The push-button 44 is sealed to prevent leakage of moisture into the housing 46.

The combination of the feature that the light bulb 28 is mounted within the concavity so that most of the light is projected at the undersurface 26, together with the feature that the undersurface 26 of the collapsible canopy 26 is deeply curved and has a very high luminous reflectance, results in the light from the light bulb 28 being focused down to illuminate a space immediately around the user. This luminous space widens towards the bottom, thereby providing the widest illumination at the ground where it is most needed. As a result of the light being very efficiently focused, the required luminosity of the light bulb is greatly reduced, enabling the umbrella to be used for several hours using an incandescent light bulb and just three 1.5 volt batteries. Alternatively, if it is desired to provide extremely bright illumination, the conventional incandescent bulb may be replaced with a halogen bulb. The three 1.5 volt batteries still suffice to provide bright illumination by the halogen bulb for more than an hour, using commercially available dry cell batteries.

In order to minimize impairment of the user's night vision, the light bulb 28 may provide red-light only, or the light may include a red-light source (or a red filter) and a white-light source, in which case the light source is switchable between a red-light setting for improving the visibility of the user and the ground in while minimizing impairment of night vision, and a white-light setting suitable for greatly improving the visibility of the user and the ground.

Figure 2:
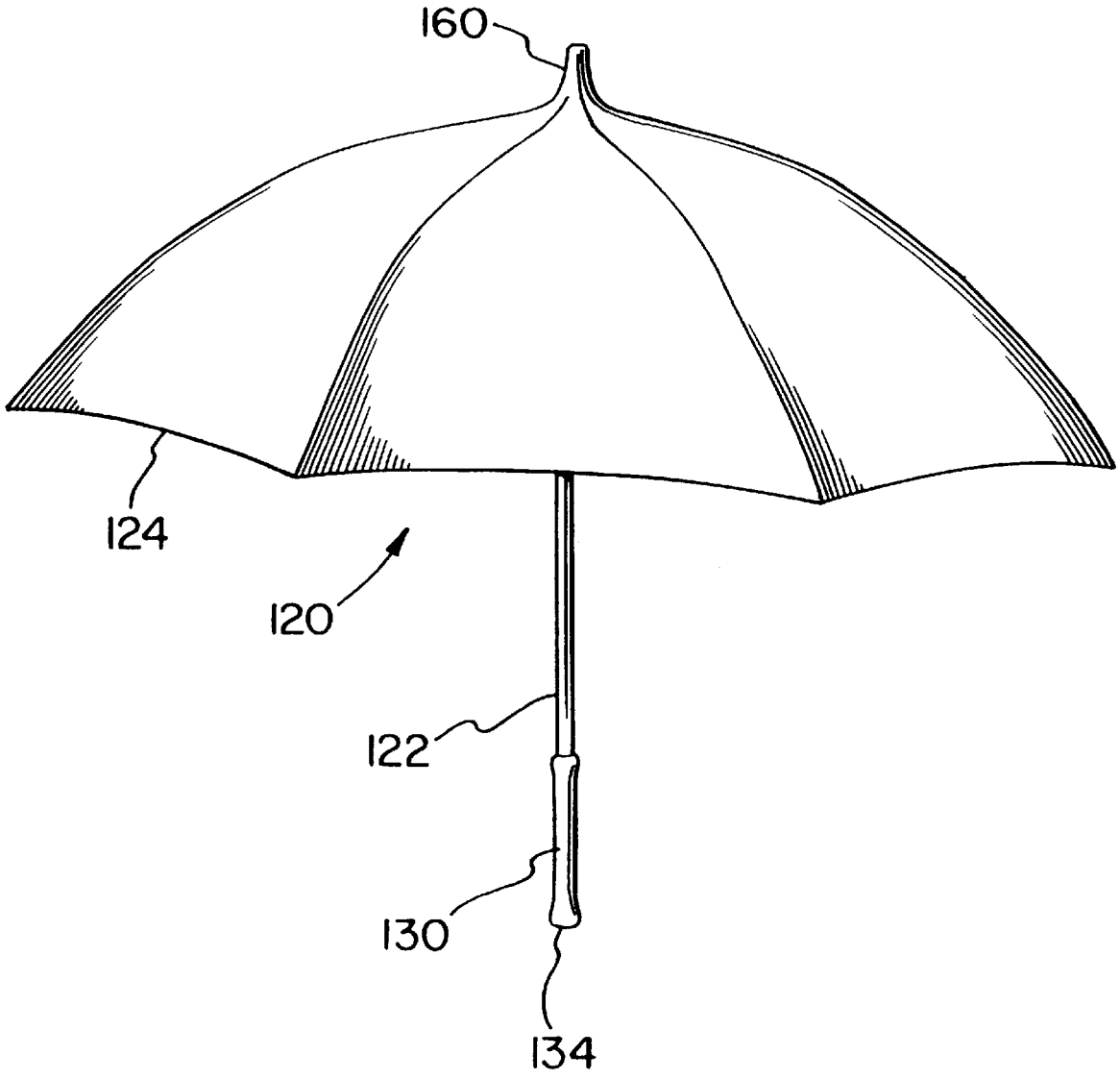
FIG. 2 that, in an elevation view, illustrates a luminous umbrella in accordance with a preferred embodiment of the present invention.

Referring to FIG. 2, there is illustrated in an elevation view, a luminous umbrella 120 in accordance with a second preferred embodiment of the invention. The luminous umbrella 120 includes a shaft 122 and a collapsible canopy 124. The collapsible canopy 124 is mounted at the distal end of the shaft 122. The collapsible canopy 124 extends radially from the shaft 122 to define a concavity underneath the collapsible canopy. The collapsible canopy 124 has a highly reflective undersurface 126. In this embodiment, the collapsible canopy 124 has a relatively shallow curvature.

Figure 3:
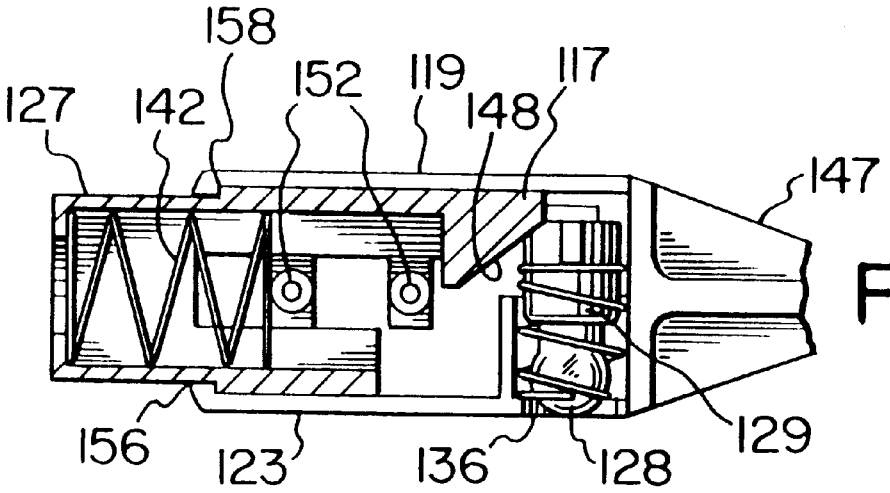
FIG. 3 that, in a sectional view, illustrates the bulb housing of the luminous umbrella of FIG. 2 with the bulb retracted.
Figure 4:
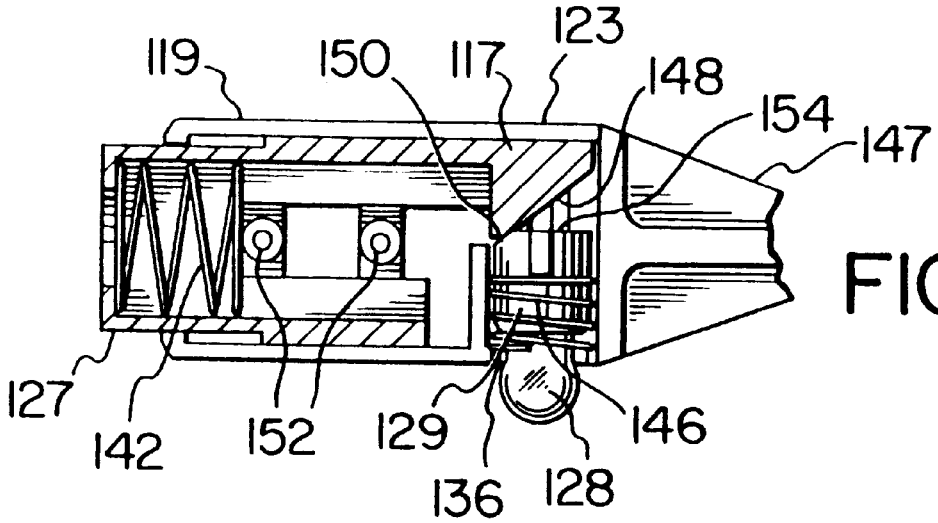
FIG. 4 that, in a sectional view, illustrates the bulb housing of the luminous umbrella of FIG. 2 with the bulb protruding.

Referring to FIGS. 3 and 4, a bulb housing 123 is shown isolated from the other elements of the umbrella of FIG. 2; in the umbrella 120, the bulb housing 123 is mounted on the shaft 122. In FIG. 2, the bulb housing 123 cannot be seen as it is mounted on the shaft 122 by housing screws 152 just under the collapsible canopy 124. The bulb housing 123 has a bulb fixture 129 for receiving a light bulb 128 and a sleeve 119, radially spaced from the shaft 122 (not shown in FIGS. 3 and 4) for internally receiving a slidingly mating bulb retraction controller piston 127. The bulb fixture 129 is biassed to a retracted position within the bulb housing 123 by a fixture spring 146. The retraction controller piston 127 annularly surrounds the shaft 122 (not shown in FIGS. 3 and 4) and protrudes through a control aperture 156 of the sleeve 119 towards the handle 130 (also not shown in FIGS. 3 and 4). The truncated conical element 147 connects to an umbrella tip 160 (shown in FIGS. 7 and 12) beyond the collapsible canopy 124. The retraction controller 127 is held in the bulb housing 123 by a shoulder 158 that cannot pass through the control aperture 156 of the bulb housing 123. The retraction controller piston 127 is biased by a retraction control return spring 142 to protrude beyond the control aperture 156 to the maximum extent possible, as determined by the position of the shoulder 158 on the retraction controller piston 127. Within the bulb housing 123, the retraction controller piston 127 has at its inner end a bulb extending control finger 117 having distally an inclined cam surface 148 that is contiguous with a mating inclined cam surface 150 on the seat 154 of the bulb fixture 129, such that if the retraction controller piston 127 is forced into the bulb housing 123, thereby compressing the control return spring 142, the action of cam surface 146 against cam surface 150 forces a radially outward movement of the bulb fixture 129, thereby compressing the fixture spring 146 and extending the light bulb 128 outwards into illuminating position through bulb aperture 136 formed in sleeve 119.

The foregoing mechanism has been designed to cooperate with existing elements of conventional umbrellas so as to retract the light bulb 128 when the umbrella is closed and to extend the light bulb 128 into illuminating position when the umbrella is open. This interaction with conventional furling/unfurling action is described in the following paragraph.

Conventionally, umbrellas may be opened by sliding an annular strut support up the shaft (away from the handle) and may be closed by sliding an annular strut support down the shaft (toward from the handle). The annular strut support receives one end of each of the struts, the other end of each of the struts helps to support the umbrella canopy in the open position when the annular strut support is slid up the handle, and pulls the umbrella canopy into the closed position when the annular strut support is slid down the handle. It is conventional to include a locking mechanism in the umbrella for holding the umbrella open or closed by, respectively, holding the annular strut support in a advanced position, away from the handle, or in a rest position, proximate to the handle. The embodiment of FIGS. 2, 3 and 4 includes this conventional feature, and utilizes it to project the light bulb 128 out of the bulb housing 123 when the annular strut support is in the advanced position and the umbrella is thereby opened. In the advanced position, as shown in FIG. 4, the annular strut support will have contacted the retraction controller piston 127, and will have pushed the retraction controller 127 into the bulb housing 123, thereby overcoming the resistance of the fixture spring 146 and the retraction control spring 142, to project the light bulb 128 out of the bulb aperture 136. As shown or described in FIG. 3, when the annular strut support is moved toward the handle 130 from the advanced position, it is moved away from the retraction controller piston 127, which will, as a result of the biassing provided by the retraction control return spring 142, extend maximally out of the sleeve 119, and the bulb fixture 129 will, as a result of the biassing provided by the bulb fixture return spring 146, be retracted within the bulb housing 123.

Figure 5:
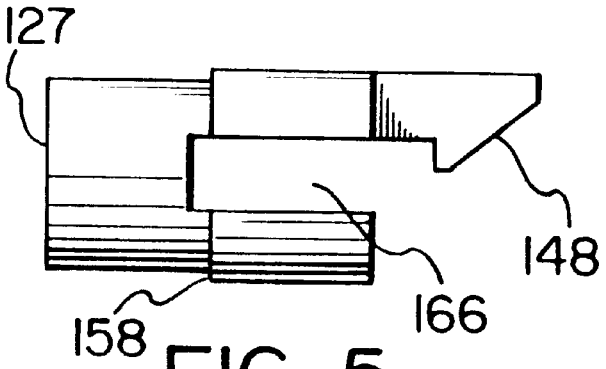
FIG. 5 that, in a sectional view, illustrates the retraction controller of the luminous umbrella of FIG. 2.
Figure 6:
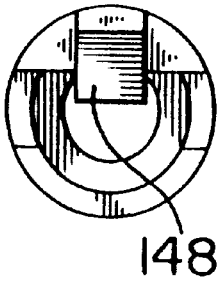
FIG. 6 that, in an end view, illustrates retraction controller of the luminous umbrella of FIG. 5.
Figure 7:
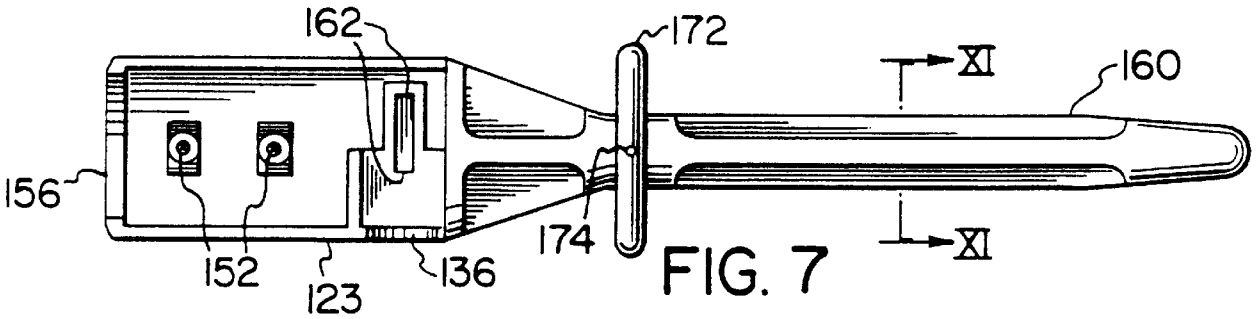
FIG. 7 that, in a side view partially in section, illustrates the bulb housing and umbrella tip of the luminous umbrella of FIG. 2.
Figure 13:
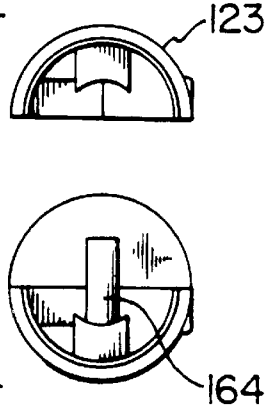
FIG. 13 that, in an exploded end view, illustrates the bulb housing of the luminous umbrella of FIG. 2.
Figure 12:
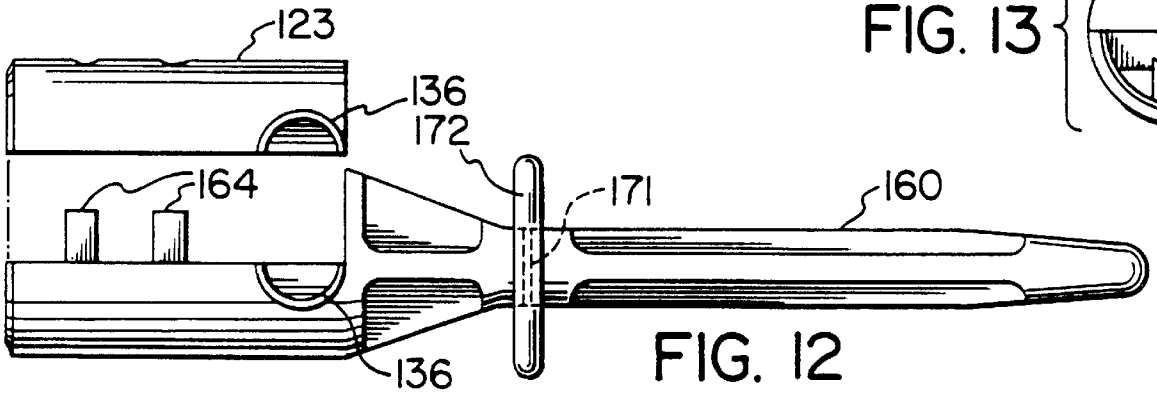
FIG. 12 that, in an exploded side view orthogonal to the side view of FIG. 7, illustrates the bulb housing and umbrella tip of the luminous umbrella of FIG. 2.

Referring to FIGS. 7, 12 and 13, the bulb housing 123 is illustrated in isolation from retraction controller piston 127 and the bulb fixture 129. The bulb housing 123 is secured about the shaft 122 by shaft posts 164 and housing screws 152. Referring to FIGS. 5 and 6, the retraction controller piston 127 is illustrated in isolation from the bulb housing 123. The retraction controller piston 127 has a retraction control track 166 that surrounds the shaft posts 164, permitting the retraction controller piston 127 to move axially relative to the shaft 122 and the bulb housing 123 within limits defined by the retraction control track 166.

Figure 11:
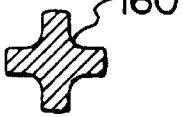
FIG. 11 that, in a sectional view, illustrates the umbrella tip of the luminous umbrella of FIG. 2.

FIGS. 7 and 13 also illustrate an umbrella tip 160, a cross-sectional view of which is shown in FIG. 11, and a rib support 172, secured to the umbrella tip 160 by a rib support fastener 174. The rib support 174 is dimensioned to secure the ribs of the canopy radially spaced from the umbrella tip 160 to reduce buckling of the ribs about the bulb housing 123. The ribs themselves are preferably designed to permit some buckling of the ribs about the bulb housing 123 when the umbrella 120 is closed without placing significant compressive forces on the bulb housing 123.

Figure 8:
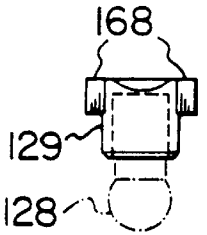
FIG. 8, that, in a side view, illustrates the bulb fixture of the luminous umbrella of FIG. 2.
Figure 9:
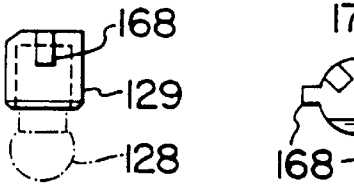
FIG. 9, that, in a side view orthogonal to the side view of FIG. 8, illustrates the bulb fixture of the luminous umbrella of FIG. 2.
Figure 10:
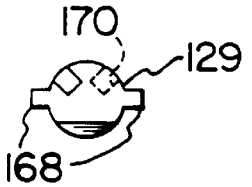
FIG. 10, that, in an end view, illustrates the bulb fixture of the luminous umbrella of FIG. 2.

FIGS. 8, 9 and 10 illustrate the bulb fixture 129 of the luminous umbrella in isolation from the bulb housing 123. The bulb fixture comprises fixture guide ribs 168 dimensioned to slide within a mating fixture control track 162 of the bulb housing 123, illustrated in FIG. 7, thereby constraining the direction of the path of travel of the bulb fixture 129 and light bulb 128 relative to the bulb housing 123 during retraction and extension The bulb fixture 129 also comprises terminals 170 for receiving power for the light bulb 170.

The bulb housing 123 is reflective to reflect light that is projected at the shaft 22. The reflective undersurface 126 is made of a highly reflective (e.g., silvered) material attached to the underside of the collapsible canopy 124. The collapsible canopy 124 comprises a substantially opaque and waterproof fabric to occlude residual light that shines though the reflective material. Due to the curvature of the undersurface 126, the light that is reflected by the undersurface 126 of the collapsible canopy 124 is focussed primarily on the area underneath the collapsible canopy 124. Of course, the focussing of the light provided by the undersurface 126 is diminished as the distance from the undersurface 126 increases, so that it is at the ground that light is projected radially beyond the collapsible canopy to the greatest extend. This illuminates the ground around the user of the umbrella to enable the user to notice puddles or other obstacles.

As with the embodiment of FIG. 1, in the embodiment of FIG. 2, the shaft ends in a handle 130. The handle 130 includes an end cap 134 that is removable to permit four 1.5V batteries to be inserted into a battery housing within the handle. The batteries are connected to the light bulb via conductors. When a push-button on the handle 130 is pressed, then the circuit between the batteries and light bulb is opened, if previously closed, or closed, if previously open, thereby turning the light off or on respectively. The push-button is sealed to prevent leakage of moisture into the battery housing.

Modifications and variations will be apparent to those skilled in the art. Specifically, in an alternative embodiment, the handle comprises a rechargeable battery that is intended to remain within the handle when being recharged, and an electrical inlet for receiving electricity to recharge the battery. In another embodiment, the light is provided by a light source that includes light control means for changing the width of the light emitted between a wide-beam setting and a narrow-beam setting. On the wide-beam setting, the light source illuminates a larger space around the user; on the narrow-beam setting, illumination is radially confined to a space immediately surrounding the user. The light source is switchable between the wide-beam setting and the narrow-beam setting by the light actuator. Accordingly, the invention is as defined in the claims.

What is claimed is:

1. A closable luminous umbrella for illuminating an illuminated space proximate to the luminous umbrella, comprising (a) a shaft;

(b) a collapsible canopy mounted on a distal end of the shaft for sheltering the user, the collapsible canopy having, when open, (i) a highly reflective concave undersurface extending to an outer periphery to define a generally circular concavity underneath the collapsible canopy;

(ii) a waterproof over-layer contiguous to the highly reflective undersurface, the waterproof over-layer including an opaque portion contiguous to the highly reflective portion of the undersurface for enhancing reflection from the highly reflective undersurface, (c) a handle mounted on the proximal end of the shaft;

(d) a light fixture for replaceably receiving and orienting a light source such that when the light source is installed and operational and the umbrella is open, the light source (i) faces the undersurface of the collapsible canopy, and (ii) is mounted on the shaft between a crest of the shaft and the handle so that at least a major portion of the light source protrudes from a surface of the shaft, such that most of the light from the light source is directed toward the ground when the open umbrella is in use in vertical orientation, either directly or by reflection from the undersurface of the collapsible canopy;

(e) a power connection means for connection to an integrable power source for integrally powering the light source to permit the light source to operate during transportation;

(f) a light switch electrically connected between the light source and the integrable power source for turning the light source on and off.

2. An umbrella as defined in claim 1 wherein the light fixture is oriented on the shaft such that the light source, when mounted and operational, is within the concavity defined by the undersurface of the collapsible canopy when open such that most of the light from the light source is projected onto the reflective undersurface of the open collapsible canopy.

3. An umbrella as defined in claim 2 wherein the open collapsible canopy is curved such that substantially all of the reflected light is focussed to be concentrated underneath the collapsible canopy.

4. An umbrella as defined in claim 2 wherein, when the umbrellas is open, the collapsible canopy is curved so that the outermost part of the canopy is substantially parallel to the shaft, thereby focussing substantially all of the light reflected by the undersurface to underneath the collapsible canopy.

5. An umbrella as defined in claim 2 wherein the umbrella comprises a power supply receptacle for replaceably receiving batteries, the batteries in the power supply receptacle being in electrical communication with the light fixture via the power connection means.

6. An umbrella as defined in claim 1 additionally including a dimmer associated with the light source for controllably brightening and dimming the light from the light source.

7. An umbrella as defined in claim 6, wherein the dimmer is incorporated into the light switch.

8. An umbrella as defined in claim 1 wherein the light source is a composite light source having a plurality of constituent coloured light sources.

9. An umbrella as defined in claim 8, wherein the coloured light sources comprise (a) a red-light source for improving the visibility of the user and the ground in the luminous space while minimizing impairment of night vision; and (b) a white-light source suitable for improving the visibility of the user and the ground in the illuminated space underneath the open canopy.

10. An umbrella as defined in claim 2 additionally comprising (i) an adjustable director for changing the direction of the light provided by the light source, the adjustable director having a wide-beam setting for radially extending the illuminated space underneath the open canopy, and a narrow-beam setting for radially confining the illuminated space underneath the open canopy; and (ii) a reflector control switch for switching the adjustable director between the wide-beam setting and the narrow-beam setting.

11. An umbrella as defined in claim 10, wherein the director control switch is incorporated into the light switch.

12. An umbrella as defined in claim 9 wherein the shaft comprises a reflective portion proximal to the light source for reflecting light projected onto the shaft.

* * * * *